United States Patent [19]

Inoue

[11] 4,132,872

[45] Jan. 2, 1979

[54] RIBBED CONICAL-CENTRAL DOME DIAPHRAGM WITH TAPERED THICKNESS COMPONENTS

[76] Inventor: Kenzo Inoue, 22, Kitatanda, Yofu-cho, Tokai-shi, Aichi-ken, Japan

[21] Appl. No.: 886,464

[22] Filed: Mar. 14, 1978

[30] Foreign Application Priority Data

Mar. 26, 1977 [JP] Japan ..... 52/33894

[51] Int. Cl.[2] ..... H04R 7/14; H04R 9/02

[52] U.S. Cl. ..... 179/115.5 R; 179/181 R; 181/165; 181/174

[58] Field of Search ..... 179/115.5 R, 181 R; 181/165, 174

*Primary Examiner*—George G. Stellar
*Attorney, Agent, or Firm*—Browdy and Neimark

[57] ABSTRACT

A movable coil type electroacoustic vibrating plate of rigid structure, composed of two principal parts, one being a thin-walled annular plate portion, having concentrical outer periphery and inner periphery, of substantially truncated conical configuration, and the other being a thin-walled circular dome-like plate portion for occupying the central circular portion of the former inside the inner periphery. The former is provided with a number of radial ribs on the inner surface thereof with an equal circumferential angular distance, and the latter is also provided with a plurality of diametrical ribs of half-moon shape on the concaved inner surface thereof with an equal circumferential angular distance. The former and the latter are integrally formed mostly and connected with the axial end portion of the bobbin provided with the voice coil.

5 Claims, 5 Drawing Figures

RIBBED CONICAL-CENTRAL DOME DIAPHRAGM WITH TAPERED THICKNESS COMPONENTS

DETAILED DESCRIPTION OF THE INVENTION

This invention relates to a vibrating plate (diaphragm), used in an electroacoustic transducer (for example a speaker or a microphone), which utilizes the inter-relation between the axial reciprocation of a movable coil, such as a voice coil, and the variation of electric current (in a magnetic field) flowing in the coil. More particularly it relates essentially to a cone type speaker. This invention was made as an improvement of a previous invention filed on Nov. 9, 1976 with the filing Ser. No. 740,292 by the present inventor, now U.S. Pat. No. 4,086,450. As the basis for this invention a series of studies were made by this inventor, and two of which closely related to this invention have already been filed with the Japanese Patent Office, i.e., Toku-Gan-Sho-51 (1976)-132232 (Japanese Patent Application) "Diaphragm of a Movable Coil Type Electroacoustic Transducer", and Jitsu-Gan-Sho-51 (1976)-127973 (Japanese Utility Model Application) "A Speaker Cone".

There are conventionally several types of electroacoustic transducers. As practically applied articles in this field, i.e., those employing a movable coil for transforming the current variation into the sound variation can be cited, for example, cone type speakers, horn type speakers, various loudspeakers, headphones, microphones, etc.

As later explained in detail, conventional cone type speakers are defective in reproducing sounds, ranging over a wide compass from high to low, in high-fidelity. In other words, a specific speaker is good only for a limited area of compass, and another speaker is similarly good only for another limited area of compass. So a plurality of cones have often been combined to cover a complete compass area of sound in order to reproduce a good and agreeable sound effect. Especially for large diametered cone-speakers, such a combination type has usually been employed. This combination type is, however, problematical for its inherent weak point regarding the sound interferrence occurring in the vicinity of cross-over frequencies.

The inventor has, to some extent, succeeded in the previously mentioned invention, which is pending with the U.S. patent, to provide a single structural cone speaker capable of reproducing sounds of wide compass in high-fidelity, instead of the conventional combination type speakers, in which improved one a plurality of ribs are disposed on the inner surface of a truncated conical shape cone to enhance the rigidity of the cone for adapting to the object of high performance cone. The present invention which has further improved the previous one is characterized, in a word, in that the rigidity of the cone is further enhanced with the aid of a centrally located dome-like plate portion which is provided with, on the concaved inner surface thereof, a plurality of half-moon shaped large ribs disposed in a diametrical direction. This internal plate portion having a plurality of half-moon shaped ribs largely contributes to the rigidity of the cone, consequently to the betterment of the sound effect.

It has been a great target in this art to make a single speaker cone having ingeniously harmonized the following important but mutually contradicting requirements necessary to the design of the cone speaker, i.e., how to reduce the mass; how to raise the rigidity; how to eliminate unnecessary or undesirable vibration; and to what extent allow the internal energy loss.

This invention has solved the above-mentioned problem to complete a vibrating plate of simple structure but capable of reproducing sounds of wide compass in high-fidelity.

It is therefore a primary object of this invention to provide a single vibrating plate capable of covering a wide range audible compass.

It is another object of this invention to provide a single vibrating plate made of a light material but of high rigidity.

It is further object of this invention to provide a single vibrating plate capable of reproducing any sound in high-fidelity and in an agreeable form in respect of the auditory sensation.

It is still further object of this invention to provide a single vibrating plate allowing a low cost mass-production.

The characteristic feature of this invention will be along with the structure thereof described hereunder, referring to the accompanying drawings in which.

Figure 1:
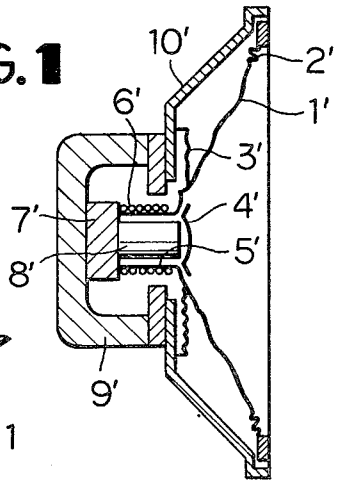
FIG. 1 is a vertical cross-sectional view of a conventional representative dynamic speaker; (prior art)
Figure 4:
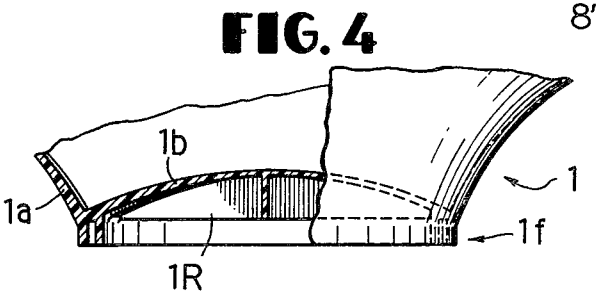
FIG. 4 is an elevation (partly cross-section) of an essential part of FIG. 2, a part being omitted.

For better understanding a conventional type representative cone speaker will be firstly outlined. A vibrating plate 1' of cone shape is, through a flexible edge portion 2' thereof and a damper 3', retained by a housing 10' and reciprocable toward and away from the same. A centrally located cap 4' is for preventing dust ingress as a dust cap in some cases and for vibrating by itself as a center cap in some other cases. On a bobbin 5', which is connected to the inner periphery of the diaphragm 1', is wound a coil 6'. Variation itself of electric current status taking place within the magnetic field, (which exists between a pole 8', being integral with a permanent magnet 7', and a yoke 9'), becomes a force to reciprocate the diaphragm 1', i.e., the vibration-causing force, which functions as a transforming means between current and sound. This is the transducer.

In conventional type speakers, especially in large sized ones, using paper or cloth material for reducing the mass thereof, reproduction of sounds in high-fidelity has been thought next to impossible, due chiefly to the deflection occurring in the vibrating plate. It has been thought quite difficult to cover a whole compass, ranging from high tone to low tone, with a single vibrating plate in high-fidelity. Various attempts have been made to overcome the problem; the most popular one among them is a combination of several diaphragms to cover the entire compass. It is, however, not free from a grave weak point, i.e., a sound interference in the vicinity of cross-over frequencies. Many attempts to solve the problem have been made in vain, by being blocked with the mutual contradiction among the above-mentioned four requirements. These four are naturally too contradictory to be completely harmonized to adapt to the object. For example, metallic speakers can be high in rigidity but are difficult to be reduced in weight; light paper-made speakers are good in allowing proper internal energy loss, but largely inferior in the rigidity, so it is difficult in this case to make an integral vibration transference between the vibration-causing portion and the edge portion. The question resides in how to make an arrangement or a compromise among the four requirements, allowable or practicable to the solving of the problem.

The present invention has substantially solved this difficult problem accompanying the conventional diaphragms, by providing a single structural diaphragm for a dynamic speaker cone, which is capable of covering the whole audible compass in high-fidelity.

Basic principles of this diaphragm, or a speaker incorporating the same, lies in (1) being a truncated conical shape with sufficient rigidity as well as the greatest possible light-weight by choosing a suitable material and a manufacturing method; (2) an integral vibration of the vibration-causing portion and the edge portion has been achieved by providing a number of radial ribs on the inner surface of the vibrating plate (annular form) and a plurality of diametrical ribs on the inner surface of the internal plate portion (corresponds to the conventional cap); and (3) the bonding of the annular vibrating plate portion and the internal plate portion together with the end portion of the coil bobbin in the vicinity of the vibration-causing portion. The structural configuration above-mentioned is quite effective for anti-deformation of the speaker, which is essential in keeping the sound fidelity and in reproducing a sound of good and agreeable auditory sensation.

Figure 2:
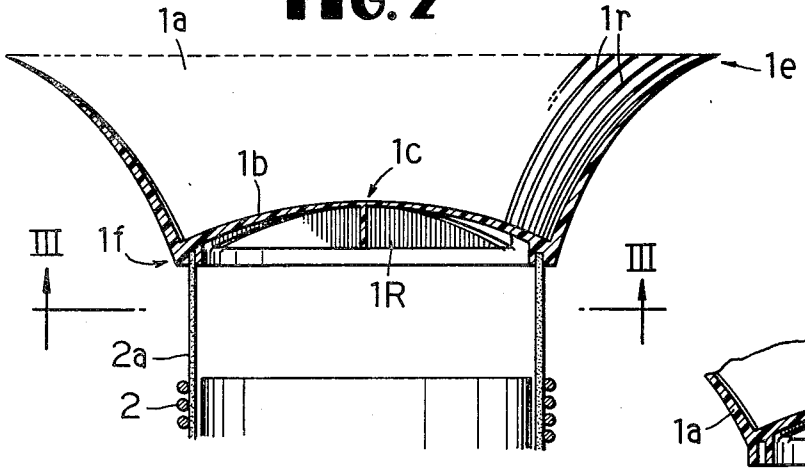
FIG. 2 is a cross-sectional view, passing through the axis, of an essential part of a first embodiment, of the vibrating plate according to the present invention.

Referring to the drawings, a preferred embodiment will be described in detail. FIG. 2 is an axial cross-sectional view of an essential portion, including the axis, of a movable coil type speaker. A diaphragm 1, a vibrating plate, of this type, being of a configuration like a morning glory flower (substantially being of truncated conical shape), generally includes two parts, an annular plate portion 1*a* and an internal circular plate portion 1*b* of dome form located in the central part, for just occupying the central circular portion of the former member 1*a* inside the inner periphery. The annular plate portion 1*a*, principal part of the diaphragm, and the internal circular plate portion 1*b*, which mainly functions as an anti-deformation means for the former 1*a*, are integrally formed in this embodiment; and the latter's great contribution to the former in respect of giving rigidity is an important factor of this invention. Concrete factors sought in this invention for attaining the object can be summarized as follows: (1) the connecting portion of the two parts 1*a*, 1*b* and the end portion of the bobbin 2*a* for the voice coil 2 is made highly rigid; (2) the internal circular plate 1*b* is, especially at its central portion, made rigid; (3) the rigidity of the annular plate portion 1*a* is greatest at the vibration-causing portion and progressively decreased toward the outer periphery; and (4) the cone is, in its whole structure, thinly walled, light in weight, and a material of low-mass and high rigidity is chosen therefor.

The vibrating plate 1 is an article made of thermoplastic resin reinforced by glass-fiber or the like (FRTP) by means of an injection molding method. LIGHTON 40 (polyphenylane-sulphite resin containing 40% of glass fiber) of Philips Corp. (U.S.) and PTB resin 1101 G30 of Toray (Japan) (containing 30% of glass fiber) are thought most suitable as the material for that. As to the coefficient of elasticity, the most important property, the former shows $150 \times 10^3$ Kg/cm$^2$ and the latter $90 \times 10^3$ Kg/cm$^2$.

The vibrating plate 1 can be made of thermosetting plastic material such as melamine or melamine-phenolic compound with successful results.

Generally speaking, high physical property and formability or plasticity are principally contradicting; so it is quite difficult to obtain a plastically formed article of low-mass (thin wall) and of high physical property. In this embodiment a vibrating plate 1 of diameter 115 mm made of the above-mentioned material is obtained in the average thickness less than 0.5 mm, thinest portion being 0.3 mm. Thickness of the plate 1 is smallest in the neighborhood of the outer periphery 1*e* and the central portion 1*c*, progressively increasing toward the rest portion thereof.

For keeping the rigidity, form and arrangement of ribs play an important role. Ribs formed on the concaved inner side (under side in FIG. 2) surface of the internal plate 1*b* are arranged such that a plurality of large sized ones 1R (three in this embodiment) diametrically span thereon, being located with an equal circumferential angular distance to each other and highest at the central portion, and a suitable number of relatively low ones 1R' are arranged (when it is needed) on the same surface between the large ones with similarly an equal circumferential angular distance to each other.

These radial ribs 1R' may be one or more but isomeric in each sector, which is formed by the diametrical ribs 1R, disposed symmetrically with the counterpart(s) in the vertically opposite sector and highest near the outer periphery of the circular plate portion 1*b* and lowest at the central portion thereof diminished progressively in height. The internal plate 1*b*, in this embodiment, is of dome form convexing outwardly or upwardly in FIG. 2; the large sized ribs 1R are of half-moon shape in elevation thereof including a chord of the dome, i.e., the half-moon shape is to be seen by cutting the dome with a plane including a center line which passes through the vertex of the dome.

The large sized ribs 1R are arranged with an equal circumferential angular distance, as earlier stated, and the lowest portion thereof reaches at least the vibration-causing portion 1*f*, i.e., the ribs are lowest in the vicinity of the periphery and highest at the central portion. The aforesaid small sized ribs 1R', preferably disposed from one to several in each sector, according to the requirements, are contrariwise highest near the outer periphery of the plate 1*b* and diminishes toward the central portion.

The large sized ribs and the small sized ones are, in close mutual cooperation, highly effective in enhancing the rigidity of the vibrating plate 1 (diaphragm).

Figure 5:
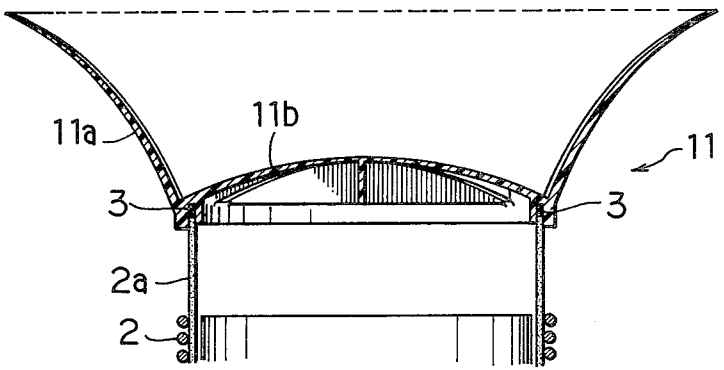
FIG. 5 is a similar view of a second embodiment to FIG. 2, showing an assembled type (bonded together) vibrating plate.

The diaphragm 1 is, in this embodiment, firmly secured to the bobbin 2*a* of the voice coil with an adhesive or bonding agent 3 (FIG. 5) at an annular groove portion disposed on the vibration causing-portion 1*f*, which largely raises the rigidity of the emvironment of the vibration-causing portion 1*f*, which is also an inneglligible good secondary effect.

Figure 3:
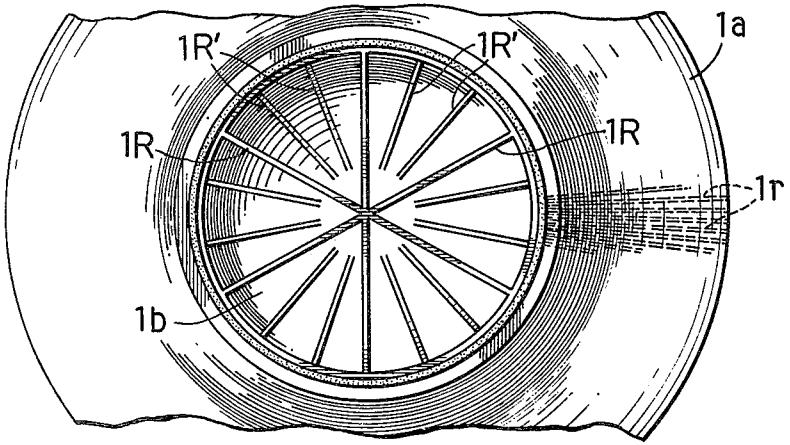
FIG. 3 is a plan view, in section, of an essential part of FIG. 2 taken along the line of III—III, a part being omitted.

The annular plate portion 1*a* is of opened morning glory flower shape, or a truncated conical shape, being provided with a number of radial ribs 1*r* as shown in FIG. 3 (120 in this embodiment) with an equal distance therebetween.

Regarding this annular plate member 1*a*, which is the principal factor of the previously mentioned pending application, a detailed description is stated in the specification Ser. No. 740,292, only the gist of which will be developed hereunder. The annular plate member of substantially truncated conical shape is mostly made of injection molded thermoplastic resin reinforced with glass fiber, wherein the thickness of the cone is greatest at the central periphery and progressively diminished toward the outer periphery, and a plurality of integrally formed radial ribs are arranged on the inner surface of the cone. A cone of such a structure has been proved by a series of experiments to be very excellent in reproducing sounds in high-fidelity with large output for the size thereof, and also very effective in the provision of simplified mass production and a good quality control method therefor.

Specific dimensions of this embodiment are as follows:

| | | | |
|---|---|---|---|
| Outer diameter | 115 mm | | |
| Height | 20 mm | | |
| Weight | 12.5 g | | |
| Wall thickness | smallest portion at the outer periphery (progressively increasing toward the center) | | 0.4 mm |
| Ribs 1r | | Height | 0.5 mm |
| | | Width | 0.5 mm |
| | | Number | 120 (in this embodiment) |
| 1R | (half-moon shape) | Height | 5 mm at the highest portion |
| | | Thickness | 0.4 mm |
| | | Number | 3 (in this embodiment) |
| 1R' | | Height | 0.5 mm |
| | | Thickness | 0.4 mm |
| | | Number | 12 (in this embodiment) |

Another embodiment will be described hereunder, which is, contrary to the previous one, a single body uniting the annular plate portion 1*a* and the dome-like portion 1*b*, i.e., composed of two parts 11*a* and 11*b* separately injection molded with the same material to be bonded together afterwards such that the circular plate 1*b*, dome-like, just plugs the central opening of the annular plate 1*a* concentrically at the time of bonding both onto the axial end portion of the bobbin 2*a*. In other words, two separately molded parts 11*a*, 11*b* are, when bonded to the bobbin portion 2*a*, simultaneously bonded firmly together at a portion adjacent to the vibration-causing portion into one vibrating plate 11, which functions as an integral vibrating plate owing to the vibration-causing force imparted, via the movement of the bobbin 2*a*, by the voice coil 2.

The vibrating plate 1, 11 of this invention are, regardless of their way of manufacturing either as an integral unity or from bonded two parts 1*a*, 11*a* and 1*b*, 11*b*, of high rigidity and of light weight. The resulting advantages are: (1) Because of less deflection or distortion between the vibration-causing portion and portions away therefrom (outer periphery or the central portion of the dome), every part of the vibrating plate, regardless of inner or outer portions, vibrates simultaneously or integrally with the voice coil without any time lag; (2) In the vicinity of the vibration-causing portion, each of the annular plate 1*a*, 11*a* and the dome 1*b*, 11*b* mutually helps raising the rigidity of the counterpart; (3) As the vibration is diffused or propagated to both of outer and inner portions, it makes possible an integral electroacoustic transforming of sounds, in high-fidelity, covering the total tone compass, high, medium, and low tone range; (4) A large sound output can be made, i.e., a cone of small outer diameter circa 115 mm is capable of outputting the same amount of sound as one with a large diameter of about 300 mm; and (5) Producing a tone of agreeable auditory sensation, a pleasant tone which can never be expected in the conventional articles, has become possible.

From the foregoing the merits of this invention can be as the conclusion summarized into the following five items:

(a) The fidelity in the electroacoustic transforming is quite high.

(b) For the dimension or size of the vibrating plate, a wider compass can be covered in high-fidelity.

(c) The output can be larger for the size of the vibrating plate.

(d) A single vibrating plate can reproduce a sound of equally wide tone compass as the conventional combination type speaker.

and (e) More pleasant auditory sensation than that in the conventional articles can be obtained.

It will be obvious to those skilled in the art that various changes may be made without departing from the scope of the invention and the invention is not to be considered limited to what is shown in the drawings and described in the specification.

What is claimed is:

1. A movable coil type electroacoustic vibrating plate having a voice coil and a bobbin therefor, being of rigid construction comprising:

an annular thin walled plate member, confined by an outer periphery and an inner periphery, the thickness thereof being largest at the inner periphery thereof and progressively diminished toward the outer periphery thereof, being of substantially a truncated conical configuration, and being provided with a number of integrally formed radial ribs extending from the inner periphery toward the outer periphery on the inner surface thereof with an equal circumferential angular distance with one another; and a circular thin walled plate member of the same material as said annular plate member, of outwardly convexed dome-like configuration, being provided with a plurality of diametrical ribs in substantially half-moon shape in elevation thereof formed on the concaved inner surface thereof with an equal circumferential angular distance with one another, whereby said annular plate member and said circular plate member are concentrically bonded together, such that the latter plugs the central opening of the former and the connecting portion of the two is bonded at the foot portion of said dome onto the axial end portion of said bobbin provided with said coil.

2. A movable coil type electroacoustic vibrating plate having a voice coil and a bobbin therefor, being of rigid construction comprising:

an integrally formed vibrating plate member composed of two portions concentrically positioned such that, one portion, an annular thin walled plate portion, of substantially truncated conical configuration, confined by an outer periphery and an inner periphery, the thickness thereof being largest at the inner periphery thereof and progressively diminished toward the outer periphery thereof, and being provided with a number of integrally formed radial ribs extending from the inner periphery toward the outer periphery on the inner surface thereof with an equal circumferential angular distance with one another; and the other portion, a central circular thin walled plate portion of dome-like shape convexing outwardly, being provided with a plurality of diametrical ribs in substantially half-moon shape in elevation thereof, occupies the centrally located otherwise would be a vacant portion of said annular plate portion, whereby said integral vibrating plate member is firmly bonded at the foot portion of said dome onto the axial end portion of said bobbin provided with said coil.

3. A vibrating plate in accordance with claim 1 or 2, wherein said circular plate portion is further comprising one or more radial ribs in each sector formed by said diametrical ribs disposed, symmetrically with the counterpart or counterparts in a vertically opposite sector, between, and lower in height than, said diametrical half-moon shaped ribs, on the concaved inner surface of said circular plate portion with an equal circumferential angular distance with one another, said radial ribs being isomeric in each sector and highest near the outer periphery of the circular plate portion and lowest at the central portion thereof diminished progressively in height.

4. A vibrating plate in accordance with claim 1 or 2 being made of injection molded thermosetting compound.

5. A vibrating plate in accordance with claim 3 being made of injection molded thermosetting compound.

* * * * *